United States Patent [19]

Stachiw et al.

[11] 3,990,123

[45] Nov. 9, 1976

[54] INFLATABLE SONAR ARRAY

[75] Inventors: Jerry D. Stachiw, Lakeside; Howard R. Talkington, La Jolla, both of Calif.

[73] Assignee: The United States of America as represented by the Secretary of the Navy, Washington, D.C.

[22] Filed: Sept. 22, 1975

[21] Appl. No.: 615,738

[52] U.S. Cl. ..... 9/8 R; 340/8 S

[51] Int. Cl.[2] ..... B63B 21/00

[58] Field of Search ..... 9/8 R; 340/7 R, 8 S, 340/2; 114/.5 R

[56] References Cited

UNITED STATES PATENTS

| | | | |
|---|---|---|---|
| 3,019,412 | 1/1962 | Crawford | 340/8 S |
| 3,155,992 | 11/1964 | Shewmake et al. | 9/11 A |
| 3,444,511 | 5/1969 | Morrow | 340/8 S |
| 3,500,408 | 3/1970 | Daughenbaugh | 9/8 R |
| 3,803,540 | 4/1974 | Mar et al. | 340/2 |

*Primary Examiner*—Trygve M. Blix
*Assistant Examiner*—Gregory W. O'Connor
*Attorney, Agent, or Firm*—Richard S. Sciascia; Ervin F. Johnston; William T. Skeer

[57] ABSTRACT

A portable submerged structure uses fluid pressure to extend a plurality of flexible conduits until the conduits become rigid. In such a rigid configuration the flexible conduits provide a rigid support which is independent of any further moorings or other conventional structure used to obtain rigidity. The invention discloses the use of an open form of independent conduits as well as conduits which are joined to provide a closed geometric figure. A packaging and deploying system using a fluid released container is also disclosed.

12 Claims, 5 Drawing Figures

INFLATABLE SONAR ARRAY

STATEMENT OF GOVERNMENT INTEREST

The invention described herein may be manufactured and used by or for the Government of the United States of America for governmental purposes without the payment of any royalties thereon or therefor.

FIELD OF INVENTION

This invention pertains to the field of marine engineering. More particularly, this invention pertains to submerged structural members. In still greater particularity, this invention pertains to fluid pressure supported structures. By way of further characterization, but without limitation thereto, this invention pertains to a portable submerged structure for the mounting of oceanographic instruments.

DESCRIPTION OF THE PRIOR ART

Collection of oceanographic data requires, in many instances, the location of sensors spaced with respect to each other in a specified relationship. This is particularly true in those oceanographic fields in which acoustic and chemical data are collected in order to make various oceanographic measurements.

Sensors useful for these purposes were heretofore held in a fixed spacial relationship by a structure that derives dimensional stability from the stiffness of the structural members or by a network of cables configured to retain some original spacial orientation. Although each of these systems is satisfactory for its intended purpose, each requires many man hours and a large number of ocean going vessels for the proper installation thereof. For example, the former requires the time and effort of underwater diver construction teams in assembling the necessary rigid framework beneath the surface of the sea. Similarly, the latter system requires the positioning of anchors and suitable guying cables which occupy a larger space in the ocean than the network spacial requirements dictate and thus interfere with navigation and free use of the ocean.

SUMMARY OF THE INVENTION

The invention overcomes the aforementioned difficulties by providing a network of distended conduits which are formed of a flexible material such that they may be stored in a minimum space and deployed with a minimum of manpower. These conduits are connected to a source of high pressure fluid to cause distention from the collapsed or stored position and are protected against excessive pressure by means of a pressure regulator. A variety of geometric shapes is possible using a simple common central connection point and deployment in a variety of attitudes is made possible by this arrangement.

STATEMENT OF THE OBJECTS OF INVENTION

It is accordingly an object of this invention to provide an improved submerged structure.

A further object of this invention is to provide a submerged structure which may be conveniently moved to the desired location and installed with a minimum of labor and materials.

A further object of this invention is to provide an improved submarine structure supported by internal fluid pressure.

A further object of this invention is to provide an improved submarine structure employing lightweight materials.

Another object of this invention is the provision of a submarine structure employing conduits made of flexible material as structural members.

Yet another object of this invention is the provision of a submarine oceanographic structure capable of a plurality of attitudes in the ocean environment.

A still further object of this invention is the provision of a closed polygonal underwater structure which is self supported by internal fluid pressure and designed for rapid and convenient deployment.

Yet another object of this invention is the provision of a portable submerged structure which may be housed in a fluid actuated releasable container.

These and other objects of the invention will become more readily apparent from the ensuing specification taken together with the drawings.

DESCRIPTION OF THE PREFERRED EMBODIMENTS

Figure 1:
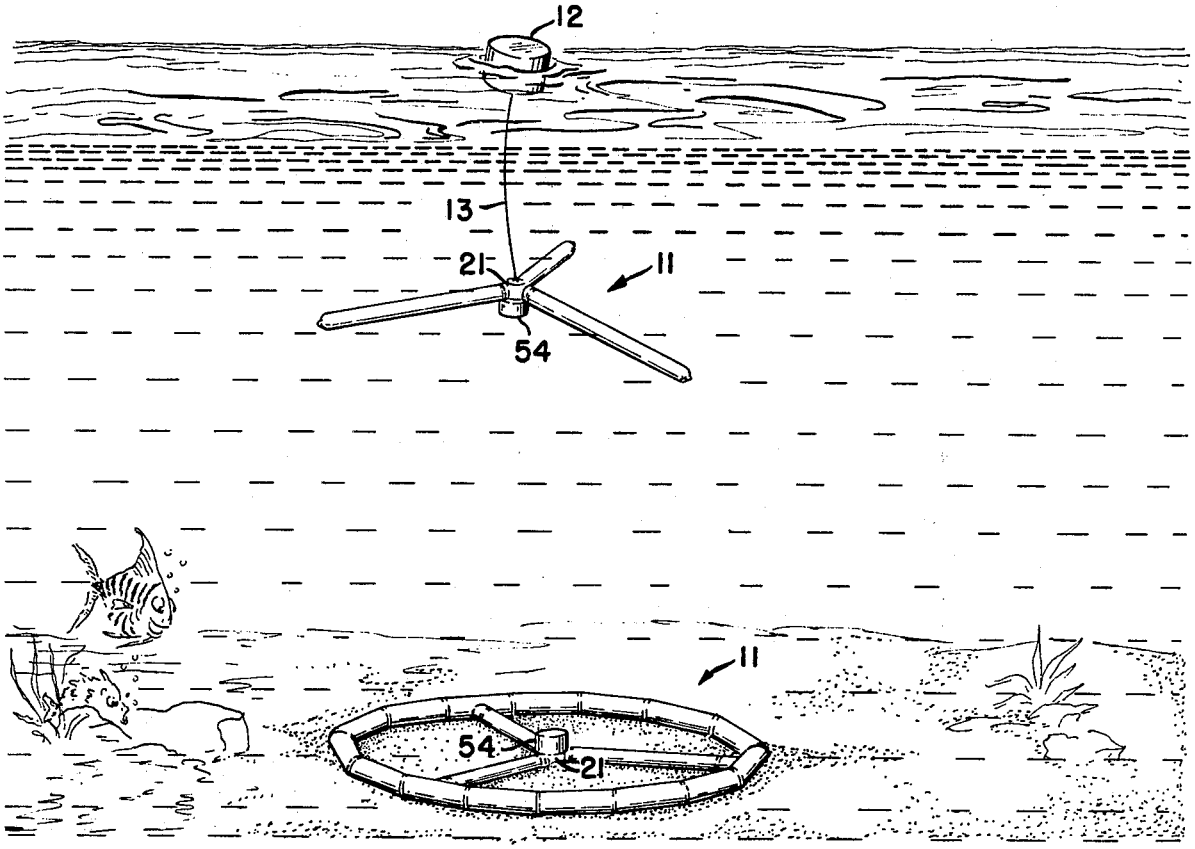
FIG. 1 is a perspective view of the operation on environment showing the invention in use.

Referring to FIG. 1, a rigid submerged structure 11 is shown attached to a surface float 12 by means of a suitable length of line 13. Obviously, the depth at which structure 11 is positioned beneath the float 12 is determined by a length of line 13. As shown, the weight of structure 11 is such that sufficient negative buoyancy is obtained and additional anchors or guying structure is not required. As will be more clearly explained herein, structure 11 extends outwardly from a lightweight metal plenum chamber 21. A source of fluid 54 is connected to plenum chamber 21 and may, for example, comprise a suitable pump.

If desired, structure 11 may rest on the floor of the sea, as also shown in FIG. 1, or may, if desired, be suspended from submerged flotation units (not shown).

Deployed as illustrated in FIG. 1, the invention may provide spaced support for oceanographic instruments such as hydrophones, thermistors, or current flow meters. Thus, structure 11 is ideally suited for measuring oceanographic parameters as might be required in such efforts as mapping the ocean currents or listening to such acoustic signals as may originate from marine life and other underwater sources.

Figure 2:
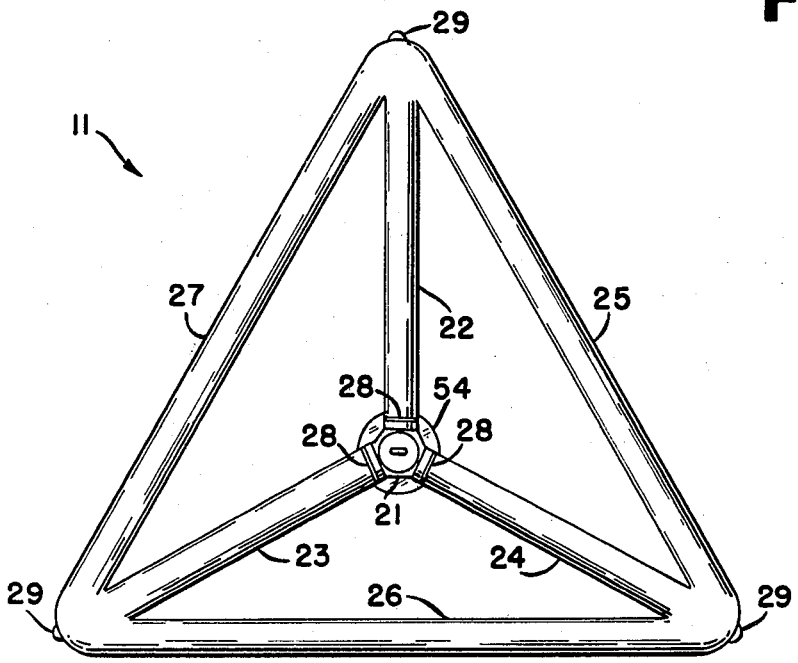
FIG. 2 is a planned view showing one form of the invention.

Referring to FIG. 2, another arrangement of structure 11 is illustrated. As shown, plenum chamber 21 provides a central support and point of origin for radiating conduits 22, 23 and 24. The distal ends of conduits 22, 23 and 24 are joined by conduits 25, 26 and 27 which extend between conduits 22, 23 and 24 and close the distal ends thereof such that a single fluid vessel is formed thereby. As may be seen, this fluid vessel is generally triangular in shape with conduits 22, 23 and 24 bisecting the vertices thereof.

Conduits 22, 23 and 24 as well as conduits 25, 26 and 27 are made of a flexible material which may be collapsed to form a compact package occupying much less volume than the conduits in their extended position. Because these conduits are stiffened with internal pressure, they are joined in such a fashion as to provide a pressure tight seal and, due to their flexible nature, a sharp vertex at the intersection of various conduits is not obtained but rather a generalized triangular figure. Thus, mountings 29 at each vertex provides a dimensionally rigid configuration upon which various, aforementioned oceanographic instrumentation units may be placed.

As shown, conduits 22, 23 and 24 are attached to plenum chamber 21 by means of suitable encircling clamps 28. The variety of clamps suitable for such purposes are well known in the marine engineering arts and need not be described in greater detail herein. Beneath plenum chamber 21 pump 54 is mounted to provide internal fluid pressure for structure 11 as will be made more readily understandable by further description therein.

Figure 3:
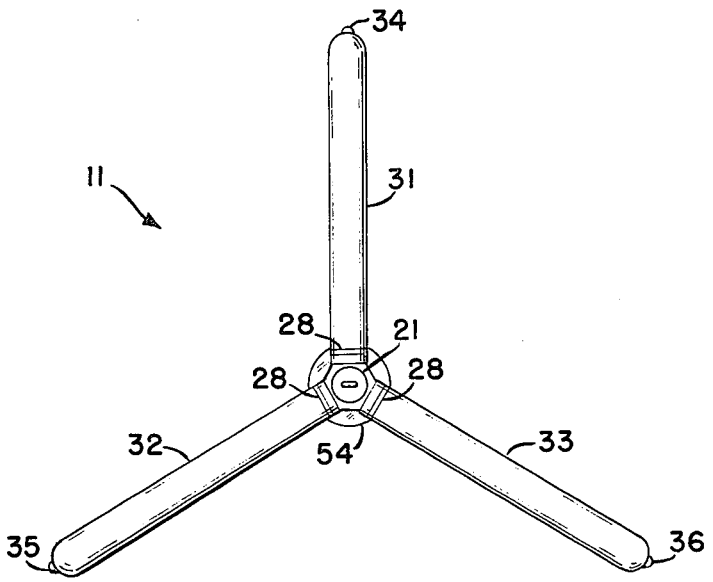
FIG. 3 and FIG. 4 are planned views showing alternative forms of the invention.

Referring to FIG. 3, a variation of submergible structure 11 is illustrated. As shown, the structure provides essentially a triangular spacial orientation between a plurality of mounting points by use of a more open configuration. Here, conduits 31, 32 and 33 diverge from plenum chamber 21 where they are similarly attached by means of clamps 28. At the distal end of conduits 31, 32 and 33 are suitable mountings 34, 35 and 36 for attachment of the oceanographic instruments as previously described. Obviously, the variation illustrated in FIG. 3 is less bulky than that of FIG. 2 and although some structural rigidity may be sacrificed by such an arrangement, a greater separation of mounting points 34, 35 and 36 is obtained for a given amount of storage space. If desired, additional rigidity may be obtained by attaching a lightweight line between mounting points 34, 35, and 36.

Obviously, other arrangements than the symmetrical triplets illustrated in FIGS. 2 and 3 may be obtained if desired. That is, plenum chamber 21 may have apertures for more than three conduits and the various conduits may be spaced other than symmetrically shown. Likewise, a plurality of plenum chambers 21 may be fashioned to provide for additional conduits extending therefrom.

Figure 4:
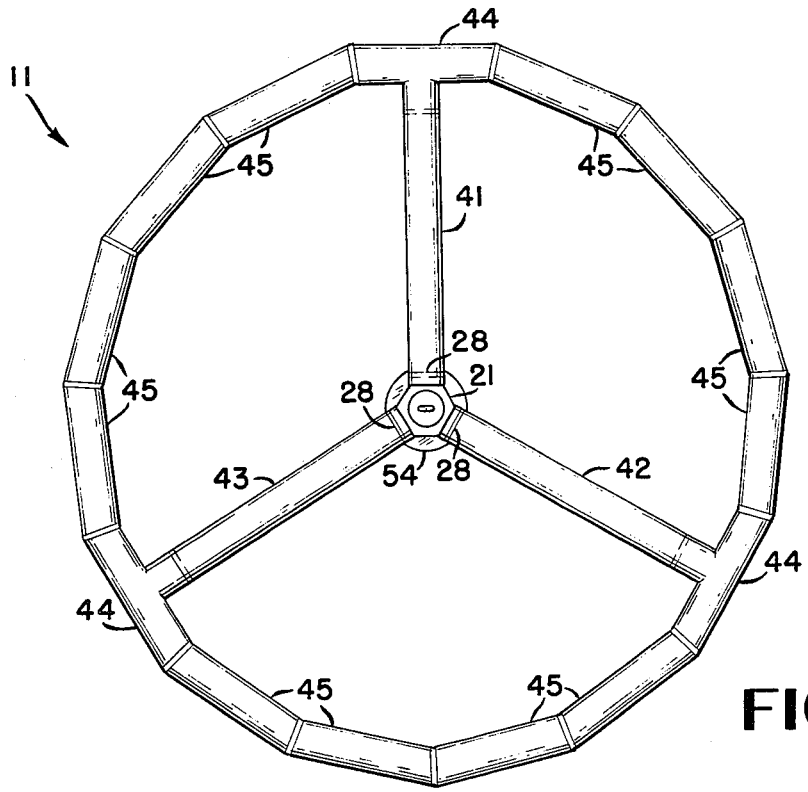

Referring to FIG. 4, a third variety of submerged structure 11 is illustrated and, as shown, illustrates the use of another closed polygonal shape. As may be readily perceived, conduits 41, 42 and 43 extend readily outward from plenum chamber 21 where they are attached by clamps 28 in the aforedescribed fashion. However, the distal ends of conduits 41, 42 and 43 are closed by means of a branching T section of conduit 44 attached thereto. Four short sections of conduit 45 join adjacent ends of conduits 44 to provide a fifteen-sided, pentadecagon. Such a pentadecagon closely approximates a torus and has the additional advantage of providing mounting points at the junction of the various conduit sections such that oceanographic instruments may be positioned along the circumference of a circumscribed torus. In this fashion, the configuration of FIG. 4 provides a versatile arrangement capable of supporting a variety of instrument configurations.

Figure 5:
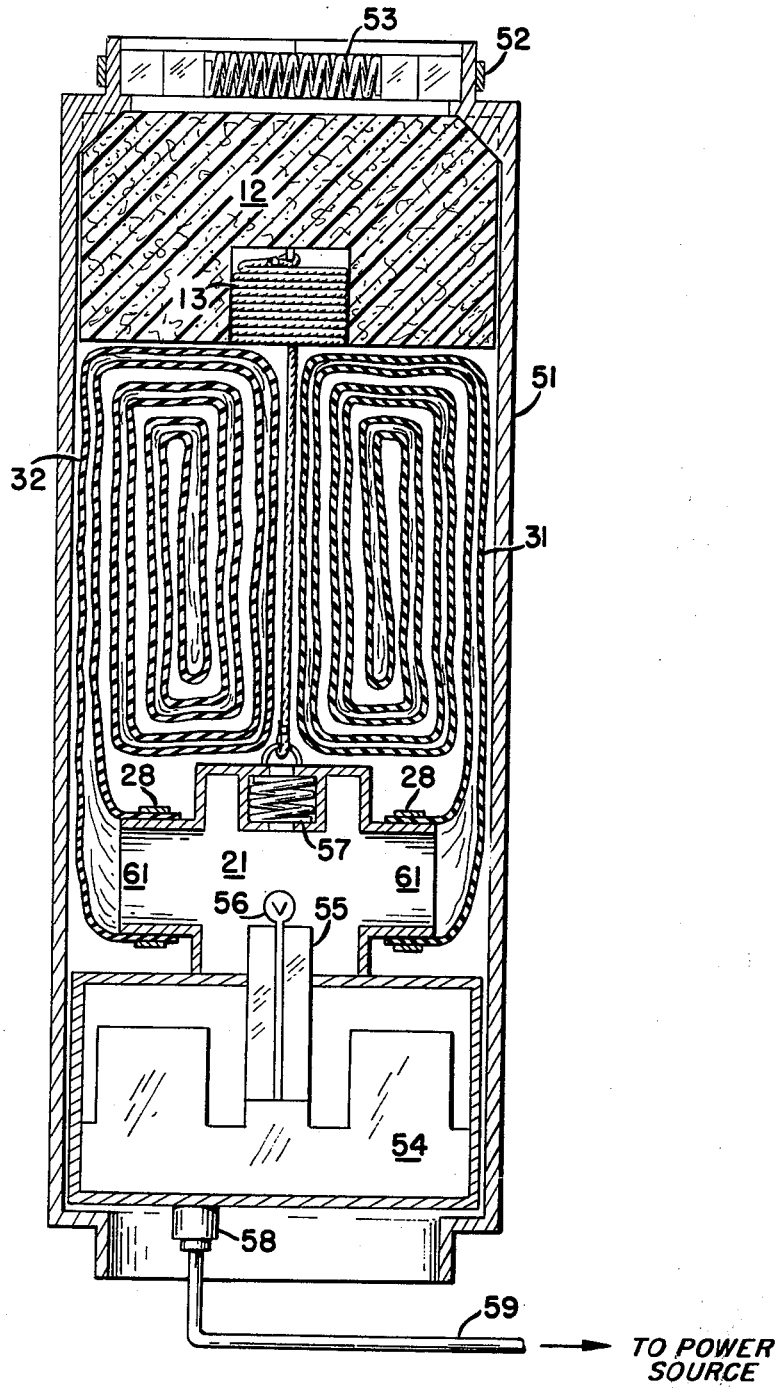
FIG. 5 is a sectional view showing the invention in its storage and deployment package.

Referring to FIG. 5, a sectional view through the structure of the invention packaged for storage and deployment is illustrated. As shown, pump 54 is connected to electrical connector 58 and conduit 59 to a suitable source of electric power. This source of electric power may, if desired, be a battery pack. Pump 54 communicates with interior of plenum chamber 21 via stand pipe 55 and a check valve 56. Of course, check valve 56 prevents water or other fluid pressure in plenum chamber 21 from reentering from pump 54. Similarly, a pressure regulation for plenum chamber 21 and attached conduits thereto is provided by a pressure relief valve 57. Pressure relief valve 57 must be spring loaded or otherwise set to provide pressure relief at a pressure sufficient to distend the flexible conduits attached to plenum chamber 21 but not to cause rupture or damage thereto. Similarly, pressure relief valve 57 must be designed to have sufficient fluid conduction capacity to accommodate a rather large array. For example, in the developmental models of the invention in which the conduits are approximately 37 centimeters in diameter and the structure extends to cover approximately 7 meters, a flow rate of 200 liters per minute is employed.

As may be best seen in FIG. 5, conduits, such as 31 and 32, are attached to plenum chamber 21 by means of apertures 61 formed in the walls thereof. As previously discussed, conduits 31 and 32 are affixed to plenum chamber 21 by suitable clamps 28.

As will be readily perceived, a variety of flexible materials may be used in the construction of conduits 31 and 32. Thus, sheets of plastic material may be formed into the conduits or, as has proven successful in operational models, the conduits may be fashioned of a woven fabric which is impregnated with a suitable plastic material or synthetic rubber compound such as to render the fabric completely fluid tight. For example, in developmental models the conduits have been fashioned of 7¼ ounce nylon fabric with a urethane and neoprene combination coating. The conduit sections are heat sealed and additionally bounded with double adhesive tape to provide fluid tight and pressure impervious joints therebetween. Additionally, this type construction permits the attachment of mounting points such as 29, 34, 35 and 36 to be readily obtained grommets which are fashioned in a conventional manner familiar to those versed in the marine engineering arts.

The upper surface of plenum chamber 21 is connected to line 13 by means of a conventional marine fastening affixed thereto and, similarly, line 13 is attached to float 12. Pump 54 and float 12 provide rigid end caps for a plurality of cover segments 51 which extend over and protect the folded conduits enclosed therein such that a rigid package which may be conveniently handled is obtained. The upper ends of segments 51 are bound together by a water soluble clamp 52 and are urged into disengagement by means of a spring loaded cruciform 53. This packaging arrangement is well understood to those versed in the marine engineering art and is frequently used on oceanographic instrument packages.

Of course, clamp 52 may be other than water soluble material if other release arrangements are desired. Also, as will be understood by those versed in the marine engineering arts, cable 59 connecting pump 54 to its power source may be such as to act as a tether connected to a battery pack resting on the bottom such as to minimize the watch circle of the deployed structure.

The foregoing description taken together with the appended claims constituted a disclosure such as to enable a person skilled in the marine engineering and oceanographic instrumentation arts and having the benefit of teachings contained therein to make and use the invention. Further, the structure herein described meets the objects of invention and generally constitutes an advance in the art unobvious to such a worker not having the benefit of the teachings contained herein.

Obviously, many modifications and variations of the present invention are possible in the light of the above teachings, and, it is therefore understood that within the scope of the disclosed inventive concept, the invention may be practiced otherwise than specifically described.

What is claimed is:

1. A portable submerged structure for establishing stable interrelationships between objects supported thereby comprising:

rigid plenum chamber means for establishing a volume of relatively high pressure;

aperture means communicating with the interior of said plenum chamber means for providing fluid flow and pressure transfer therefrom;

conduit means attached to said plenum chamber in fluid tight relation and in cooperation with said aperture means said conduit means being made of a flexible material so as to be distended by the fluid pressure and fluid flow transmitted thereto via said aperture means for forming a single fluid vessel comprised of structural members effectively connected to the objects for support thereof;

fluid source means connected to said plenum chamber means for timely supply of fluid thereto; and pressure regulator means connected to said plenum chamber means and communicating between the exterior and interior thereof for keeping the fluid pressure within predetermined limits during periods of fluid supply thereto by said fluid source means.

2. A portable submerged structure according to claim 1 in which said plenum chamber is made of a lightweight metal.

3. A portable submerged structure according to claim 1 in which said conduit means is fabricated of a lightweight, woven fabric impregnated with a plastic material to render it fluid light.

4. A portable submerged structure according to claim 3 in which said woven fabric is made of synthetic fibers.

5. A portable submerged structure according to claim 4 in which said conduit means formed fillable vessel is fashioned of bonded and taped segments to have a generally triangular shape.

6. A portable submerged structure according to claim 4 in which said conduit means formed fillable vessel is fashioned of bonded and taped segments to have a generally polygonal shape.

7. A portable submerged structure according to claim 4 in which said polygonal shape is a pentadecagon.

8. A portable submerged structure according to claim 4 in which said fluid source means is an electrically operated fluid pump.

9. A portable submerged structure according to claim 8 in which said fluid pump supplies fluid to the aforesaid plenum chamber through a stand pipe and check valve.

10. A portable submerged structure according to claim 1 in which said pressure regulator means includes a high-volume fluid relief valve.

11. A portable submerged structure according to claim 1 further including:

float means for providing buoyant support for said structure;

a predetermined length of line connected between said float means and said plenum chamber, whereby said chamber is suspended beneath the surface of a body of fluid in which the structure is submerged; and a plurality of cover segments extending between said float means and the aforesaid fluid source means to form a housing enclosing the aforerecited means.

12. A portable submerged structure according to claim 11 further including a a fluid actuated release mechanism connecting the plurality of cover segments, whereby deployment and storage of the portable submerged structure may be conveniently facilitated.

* * * * *